US007585033B2

(12) United States Patent
Holt

(10) Patent No.: US 7,585,033 B2
(45) Date of Patent: Sep. 8, 2009

(54) MULTI-FUNCTIONAL TABLE

(76) Inventor: Gary W. Holt, 1721 Cordoba Ct., Plano, TX (US) 75074

( * ) Notice: Subject to any disclaimer, the term of this patent is extended or adjusted under 35 U.S.C. 154(b) by 544 days.

(21) Appl. No.: 11/329,750

(22) Filed: Jan. 11, 2006

(65) Prior Publication Data

US 2006/0156962 A1 Jul. 20, 2006

Related U.S. Application Data

(60) Provisional application No. 60/644,819, filed on Jan. 18, 2005.

(51) Int. Cl.
*A47B 97/00* (2006.01)

(52) U.S. Cl. ..... 312/311; 312/330.1; 312/27; 108/138; 108/141

(58) Field of Classification Search ..... 312/330.1, 312/350, 311, 223.3, 196, 208.1, 312, 319.2, 312/319.3, 8.2, 8.3, 27–30, 209, 266, 282, 312/305; 108/25, 26, 50.01, 50.02, 23, 138–141; 248/285.1, 286.1, 296.1, 125.7, 276.1, 178.1, 248/184.1, 179.1, 185.1
See application file for complete search history.

(56) References Cited

U.S. PATENT DOCUMENTS 692,861 A * 2/1902 Kersey ..... 312/27
719,625 A * 2/1903 Throm ..... 312/27
790,217 A * 5/1905 Mason ..... 108/1
1,285,881 A * 11/1918 Zaun ..... 312/29
1,928,327 A * 9/1933 Butler ..... 312/310
2,525,975 A * 10/1950 Thomas et al. ..... 312/22
2,612,422 A * 9/1952 Sarkus ..... 108/141
2,740,678 A * 4/1956 Campbell ..... 108/140
2,919,966 A * 1/1960 Preston ..... 312/27
3,030,165 A * 4/1962 Nagy ..... 312/311
3,212,748 A * 10/1965 Faurot ..... 248/458
4,117,781 A 10/1978 Middleton et al.
4,413,868 A * 11/1983 Gorkiewicz ..... 312/211
4,482,196 A * 11/1984 Wolens ..... 439/1
5,238,300 A * 8/1993 Slivon et al. ..... 312/235.1
5,588,697 A * 12/1996 Yoshida et al. ..... 297/173
5,647,636 A * 7/1997 Allen ..... 297/344.21
5,842,743 A 12/1998 Wright et al.
5,979,337 A * 11/1999 Clark et al. ..... 108/43
6,761,398 B2 7/2004 Bentley et al.
6,802,265 B1 10/2004 Dodson et al.
6,928,932 B1 * 8/2005 Ferrill ..... 108/23

* cited by examiner

*Primary Examiner*—Janet M Wilkens
(74) *Attorney, Agent, or Firm*—Michael A. O'Neil

(57) ABSTRACT

A multi-functional table comprises an adjustable second support surface recessed below the upper support surface which extends outward therefrom for use as by a person seated adjacent to the table. When not in use, the second support surface is stored beneath the upper support surface of the table, requiring no additional storage or space requirements for the second support surface.

8 Claims, 9 Drawing Sheets

MULTI-FUNCTIONAL TABLE

CROSS-REFERENCE TO RELATED APPLICATIONS

This application claims priority of provisional Application Ser. No. 60/644,819 filed Jan. 18, 2005, the entire content of which is incorporated herein by reference.

TECHNICAL FIELD

This invention relates generally to furniture, and more particularly to a table that provides an adjustable second surface for use by persons seated next to the table.

BACKGROUND AND SUMMARY OF THE INVENTION

As is well known, end tables are almost universally utilized in conjunction with couches, chairs, and other seating devices. End tables universally comprise an upper support surface which is employed for long term support and display of lamps, photographs and pictures, memorabilia, and similar items. For this reason the upper support surface of an end table rarely provides room for temporarily supporting food items, beverages, books and other reading materials, computers, etc. Even if space is available thereon, the upper support surface of an end table is not a convenient location for temporary support of items to be used by a person seated next to the end table because the upper surface thereof is located to the side of and somewhat rearwardly relative to the person seated adjacent thereto.

Currently, items such as TV trays, portable or folding tables, and coffee tables are used as support surfaces by persons sitting on couches, chairs and the like. However, each of these options has problems inherent to its design. Most TV trays rest either directly upon or on top of a person's lap, limiting mobility of the person using the tray. Portable trays on collapsible stands allow more mobility, but restrict movement of the feet and legs to a limited area and are not conducive for use while in a reclined position. Additionally, portable trays are usually not capable of being placed directly over the user's lap, thus requiring the user to lean forward for better access to the items on the tray. Moreover, collapsible trays are susceptible to being turned over by other persons, pets, or children. Further, when not in use, TV trays and portable or folding tables must be stored in a cabinet, closet, or the like.

The present invention comprises a multi-functional table which overcomes the foregoing and other difficulties. In accordance with the broader aspects of the preferred embodiment, a table comprises an adjustable second support surface which may be used by a person seated adjacent to the table for use as a work surface or to support various items. When not in use, the second support surface stores inside the table. When the person seated adjacent to the table needs a second support surface, it is simply pulled outwardly from inside the table and positioned either in front of or above the person's lap.

In accordance with the more specific aspects of the invention, a second support surface is extendable from inside the table and may be adjusted to various horizontal and vertical positions. A person seated next to the table may place items such as a laptop computer, meals, beverages, books, and other various items on the second support surface while it is extended. The person is free to rise, adjust their seating position, or recline without significant movement of the second support surface and without disturbing items placed thereon.

The person simply moves the second support surface sufficiently to allow the desired motion, if any movement of the second support surface is required at all. The second support surface is supported by a substantially horizontal arm extending from inside the table. The second support surface does not require any additional support other than the horizontal arm so there are no legs or stands which inhibit movement of the person's feet or legs, nor is there anything to block movement of pets or small children which may be at or near the person's feet.

The horizontal arm supporting the second support surface may be adjusted to various settings away from the table, enabling a person to adjust the second support surface to accommodate different seating positions and various arm widths of the seating surface. In addition, the adjustability of the horizontal arm allows the arm and support surface to collapse into a more compact unit, requiring less space inside the table for storage, thereby facilitating a smaller size table which may be manufactured at a lesser cost.

When not in use, the second support surface is recessed beneath the upper support surface of the table, so there are no storage or space requirements for the second support surface. In addition to being used next to couches or chairs, the present invention may also be used in the design of a night stand or other table designs and configurations.

BRIEF DESCRIPTION OF THE DRAWINGS

A more complete understanding of the present invention may be had by reference to the following Detailed Description when taken in connection with the accompanying Drawings, wherein.

DETAILED DESCRIPTION

Figure 1:
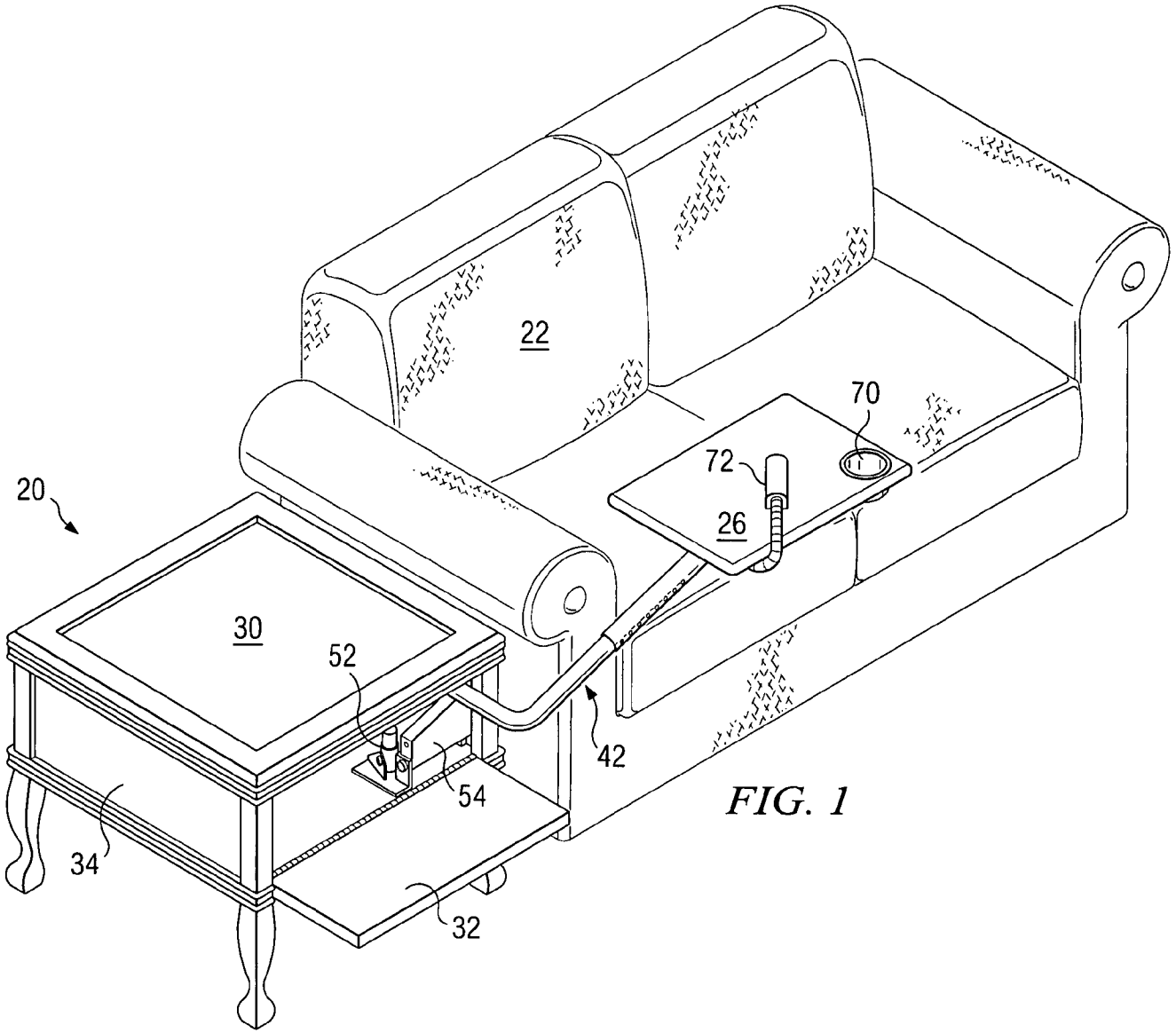
FIG. 1 is a perspective view illustrating one embodiment of the present invention in use.

Referring to the Drawings, and particularly to FIG. 1 thereof, there is shown a multi-functional table 20 comprising a first embodiment of the invention. Although the illustrations show the invention embodied as an end table, the present invention can also be configured for use as a night stand or other table design or configurations.

The table 20 includes an upper support surface and an enclosure situated immediately below the upper support surface. A person seated on a couch 22 removes a second support surface 26 from the enclosure of the table 20 and guides the second support surface 26 until it is placed in the desired position. The second support surface 26 is a substantially planar surface constructed from wood, metals, plastics, and/or other rigid materials known to those skilled in the art and commonly used in furniture manufacture.

Figure 2:
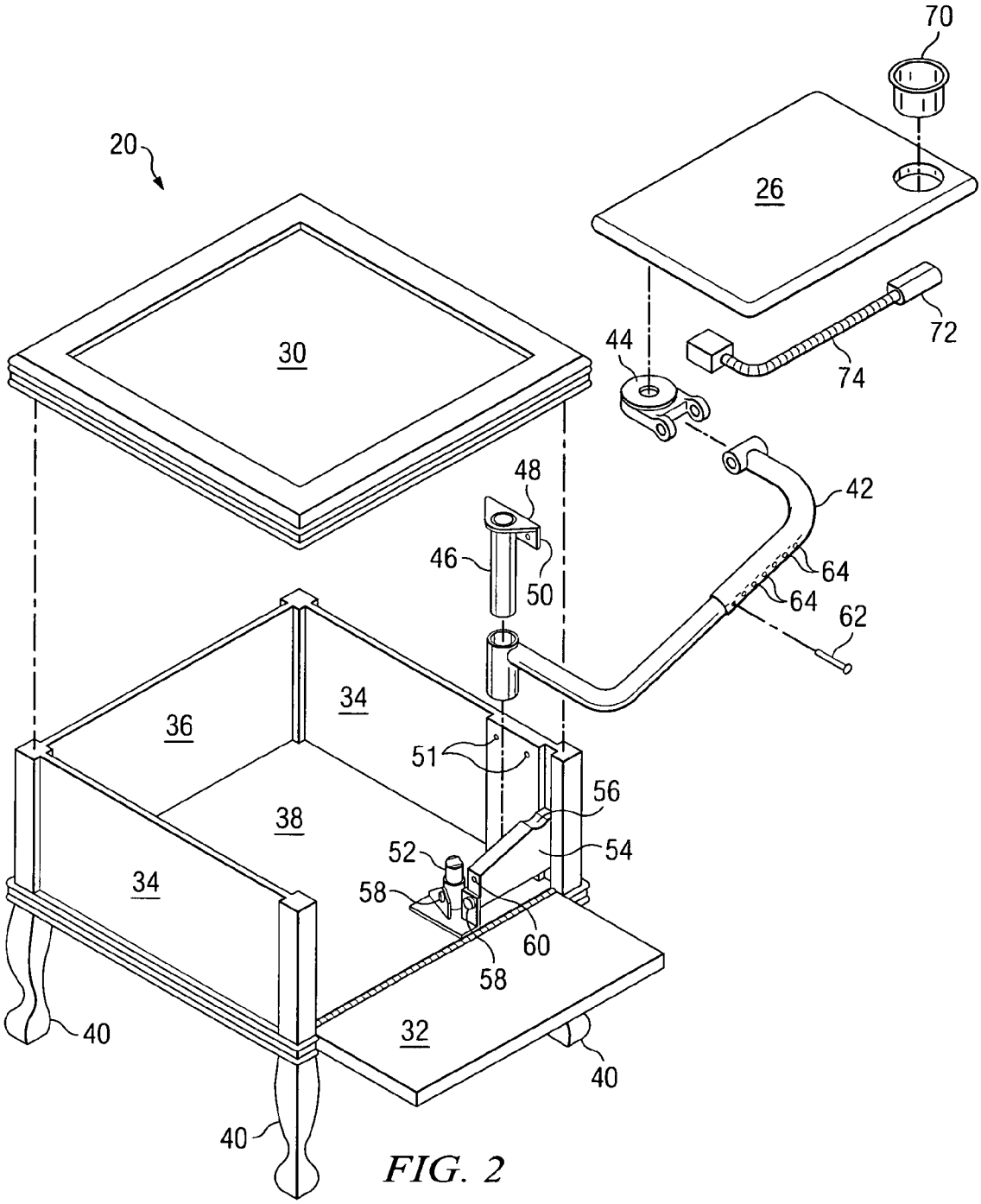
FIG. 2 is an enlarged, exploded perspective view of the embodiment shown in FIG. 1.
Figure 2A:
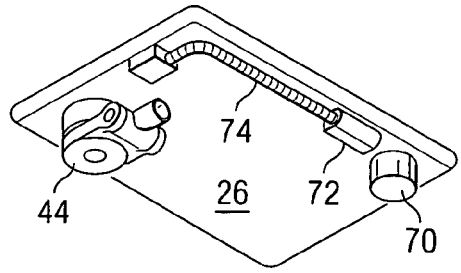
FIG. 2A is a bottom view further illustrating the embodiment of FIG. 1.

Referring specifically to FIGS. 2 and 2A, the table 20 comprises an upper support surface 30, a front panel 32, two side panels 34, a back panel 36, and a bottom panel 38, which together define an enclosure situated immediately below the upper support surface 30. The preferred embodiment shown of the table 20 comprises four legs 40 which provide support for the table 20.

The second support surface 26 is mounted on a horizontal arm 42 by a support plate 44. The arm 42 extends from beneath the upper support surface 30 of the table 20 where it is rotatably supported on a vertical shaft 46. The vertical shaft 46 is secured to the one side panel 34 by a bracket 48 and fasteners extending through apertures 50 located on each side of the bracket 48 receiving apertures 51 located near the top of the side panel 34. The arm 42 and vertical shaft 46 may be fabricated from wood, various metals, or plastics known to those skilled in the art and commonly used in furniture manufacture.

To remove the second support surface 26 from beneath the upper support surface 30, the front panel 32 is folded down. As the second support surface 26 is pulled from under the upper support surface 30, the arm 42 rotates around the vertical shaft 46 and engages a cam 52 which lifts the arm 42 and guides the arm 42 up onto a shelf 54. The arm 42 travels up the shelf 54 until it reaches an optional cradle 56 located at the top of the shelf 54. If used, the cradle secures the arm 42 in place while the second support surface 26 is in use. The cam 52 and the shelf 54 are both adjustable to various heights by means of locking pins 58 and receiving apertures 60 located along the vertical axis of the cam 52 and the end of the shelf 54. Both the cam 52 and the shelf 54 may be fabricated from wood, various metals, or plastics known to those skilled in the art.

The arm 42 is adjustable to various horizontal positions by means of a locking pin 62 which may be placed in one of several apertures 64 located along the horizontal access of the arm 42. The adjustability of the arm 42 allows the arm 42 to be collapsed into a narrow configuration before recessing the arm back under the upper support surface 30. Because the arm can be collapsed, the space inside the table 20 to house the arm 42 and second support surface 26 is minimized, requiring less material to construct the table 20, thus making the table more affordable to manufacture. The adjustability of the arm 42 also enables the table 20 to be used with a wide variety of furniture types having varying arm widths and further allows the second support surface 26 to be used at different distances away from the table 20. Specifically, the enclosure of the table 20 may be constructed of various depths. For example, the table may be constructed so as to receive the second support surface 26 with a laptop computer positioned thereon.

The second support surface 26 may be equipped with accessories. Referring to FIG. 2A, the second support surface 26 may be equipped with a cup holder 70 and a light 72. If used, the light 72 is mounted on the under side of the second support surface 26 and is mounted on a flexible neck 74 allowing the light to be adjusted into an infinite variety of positions above the second support surface 26. The table 20 and second support surface 26 may also be equipped with other accessories to accommodate different needs of a user, including, but not limited to an electrical outlet mounted on the second support surface 26 or below the upper support surface 30 of the table 20, as well as a shallow drawer that may be mounted below the second support surface 26.

Figure 3:
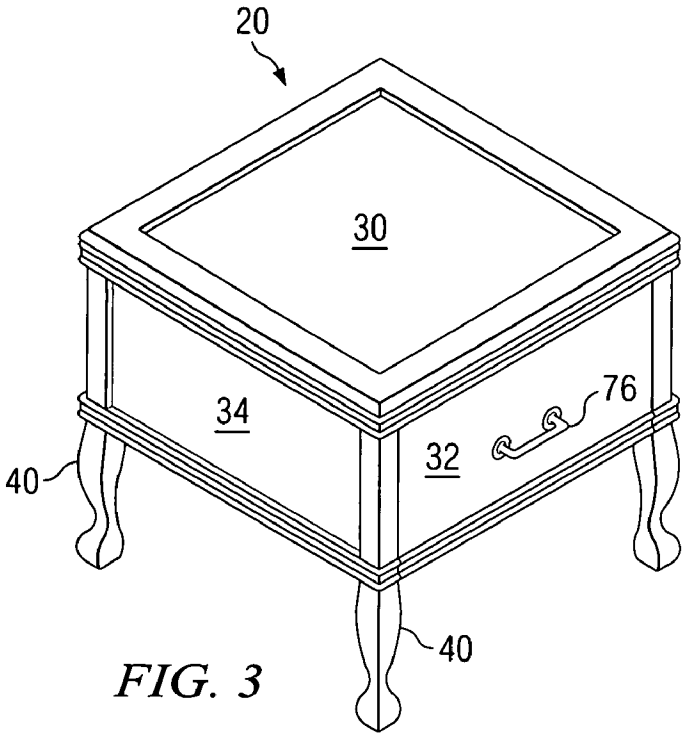
FIG. 3 is a perspective view illustrating an alternate view of the embodiment of FIG. 1 in its closed configuration.

Referring specifically to FIG. 3, there is shown a view of the table 20 with the second support surface stored therein. The front panel 32 is folded up to hide the second support 26 from view when not in use. The front panel 32 is equipped with a handle 76 to enable operation of the front panel 32.

Figure 4:
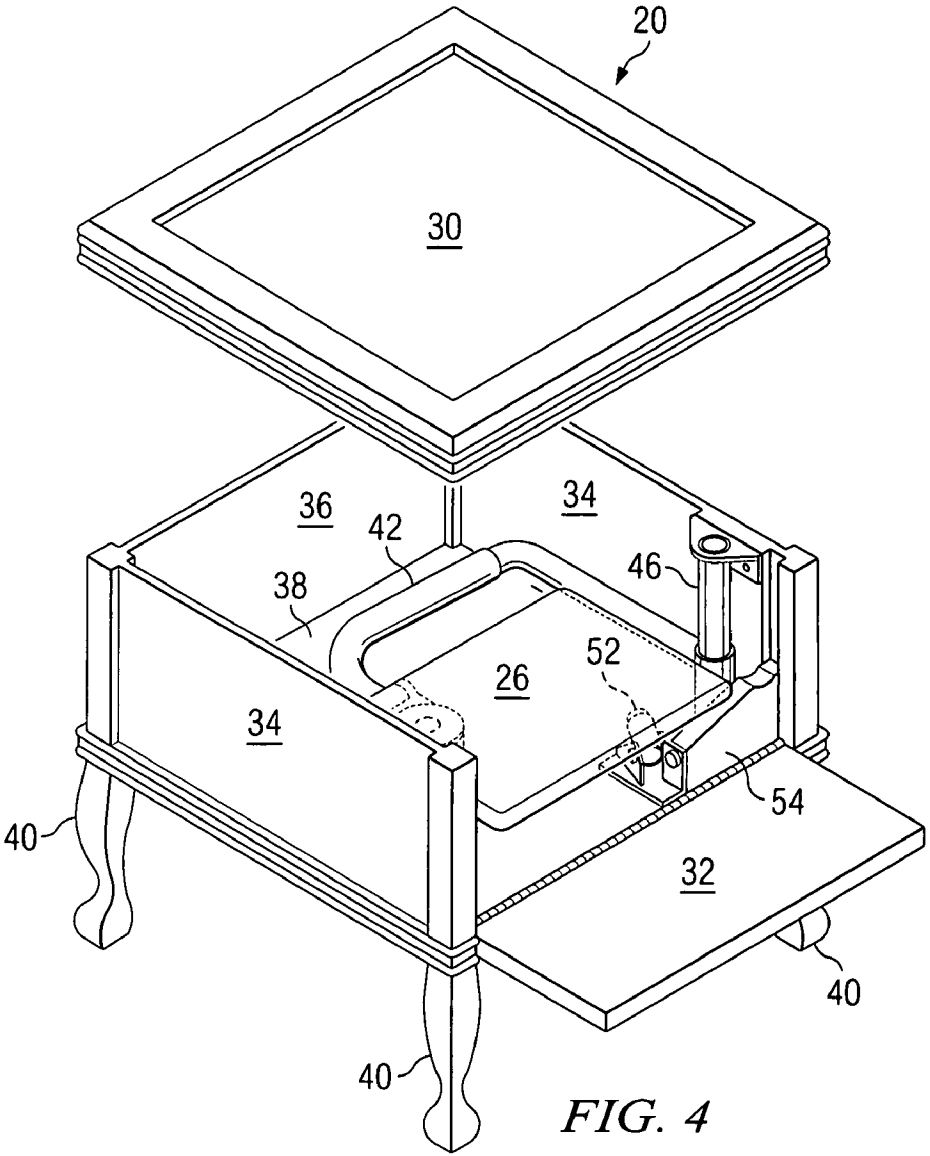
FIG. 4 is perspective view illustrating yet another view the embodiment shown in FIG. 1.
Figure 5C:
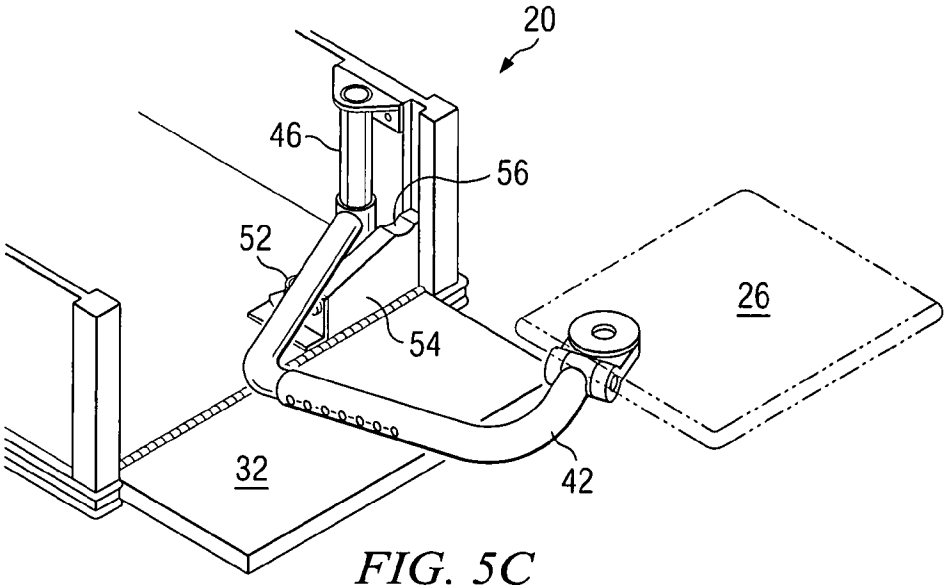
FIG. 5 is a perspective view illustrating the mechanical movements and range of motion of the embodiment shown in FIG. 1.
Figure 5B:
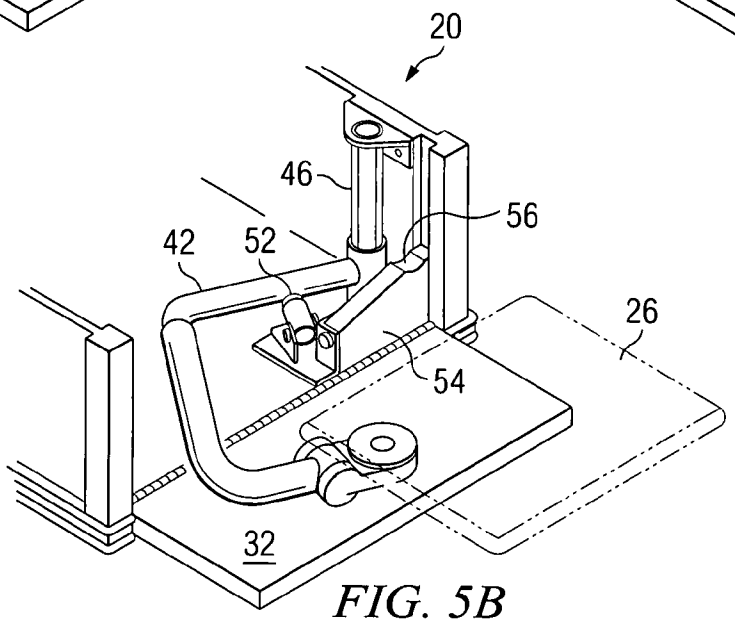
Figure 5A:
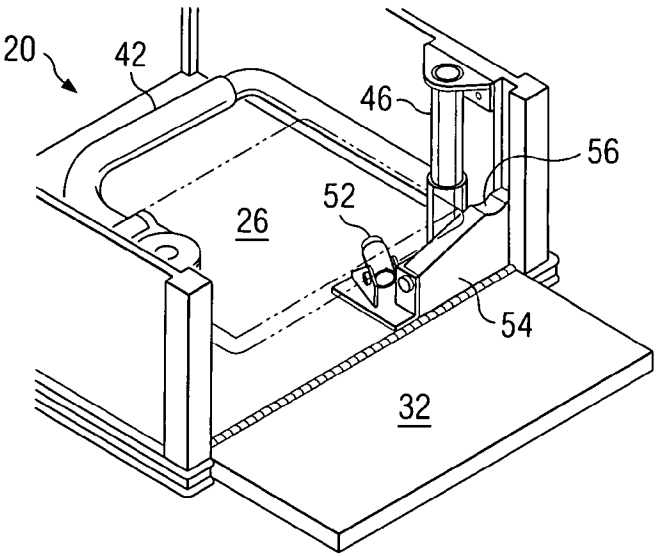
Figure 5F:
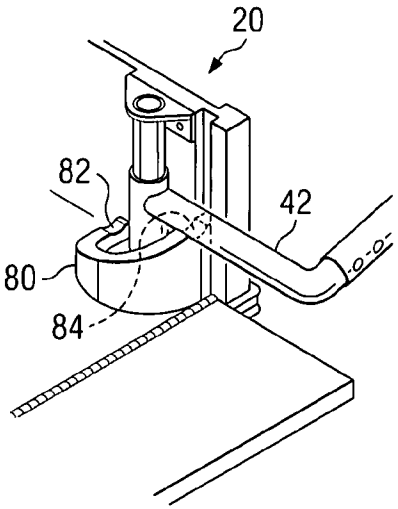
Figure 5D:
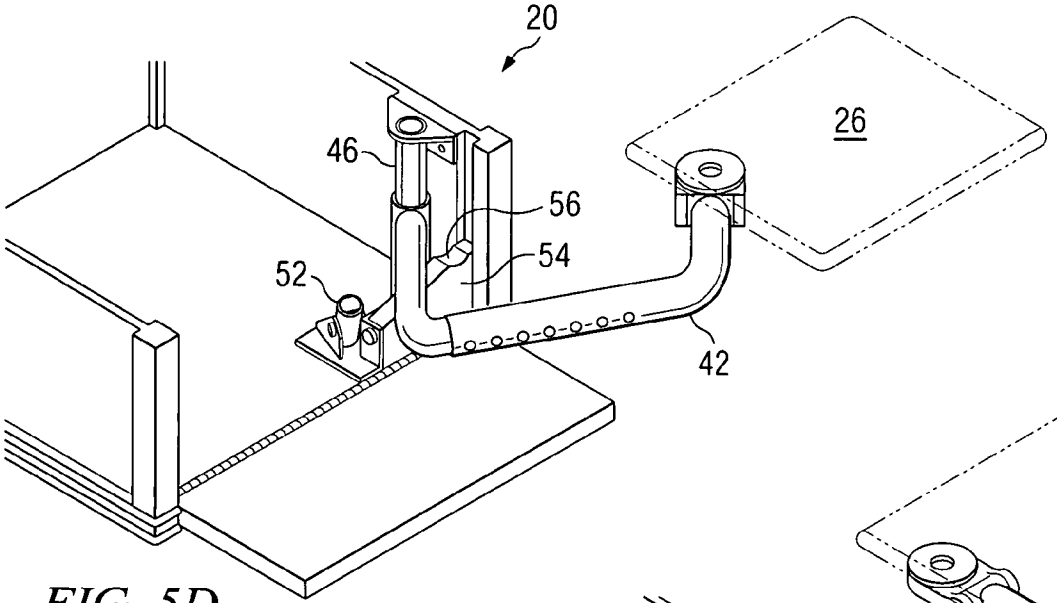
Figure 5E:
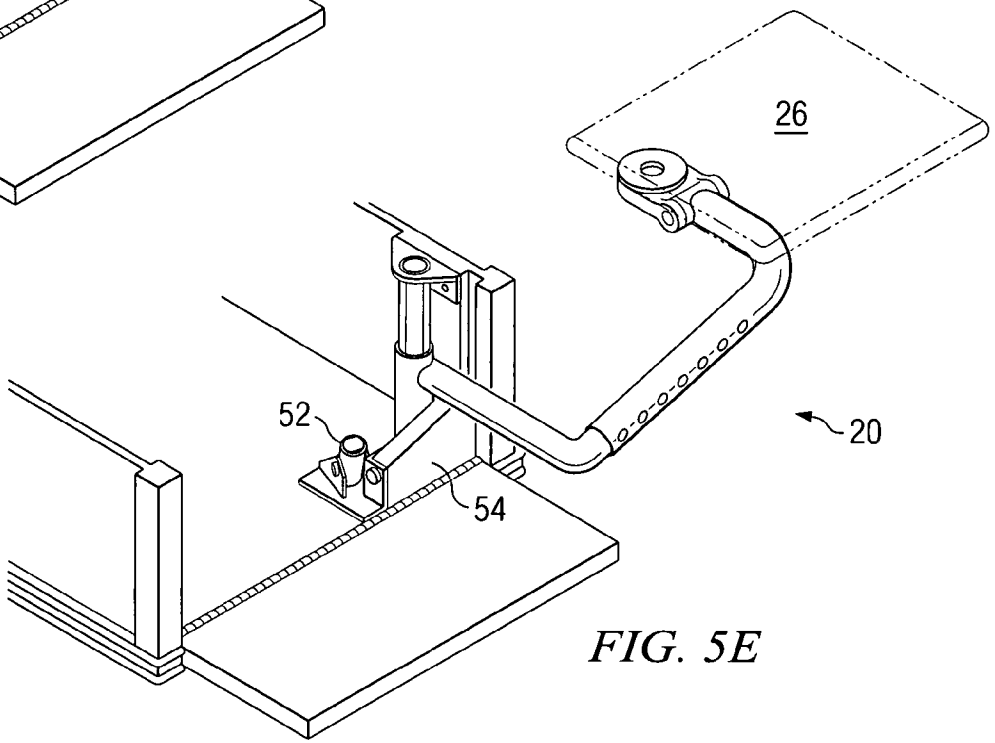

Referring specifically to FIG. 4, there is shown a view of the table 20 with the second support surface 26 recessed inside the table 20 below the upper support surface 30. FIGS. 5A through 5E, inclusive, illustrate the table 20 at all stages of storage and full extension. FIG. 5A illustrates the second support surface 26 as stored inside the table 20 with the arm 42 collapsed to the most narrow setting. FIG. 5B illustrates the arm 42 meeting the cam 52. The cam 52 guides the arm onto the shelf 54 as illustrated in FIG. 5C. FIG. 5D illustrates the arm 42 traveling along the shelf 54 towards the top of the shelf 54. FIG. 5E illustrates the arm 42 resting in the optional cradle 56 at the top of the shelf 54, where the arm 42 can be adjusted horizontally for the second support surface 26 to be used. Referring to FIG. 5F, there is shown the table 20 with an alternative spiral shelf 80, which combines the function of the cam 52 and the shelf 54. The arm 42 rests in a bottom cradle 82 located at the bottom of the shelf 80 when the second support surface 26 is stored beneath the upper support surface 30. Instead of a cam guiding the arm onto a shelf, the arm 42 travels up along the shelf 81 from the bottom cradle 82 to a top cradle 84, which support the arm 42 when the second support surface 26 is in use.

Figure 6:
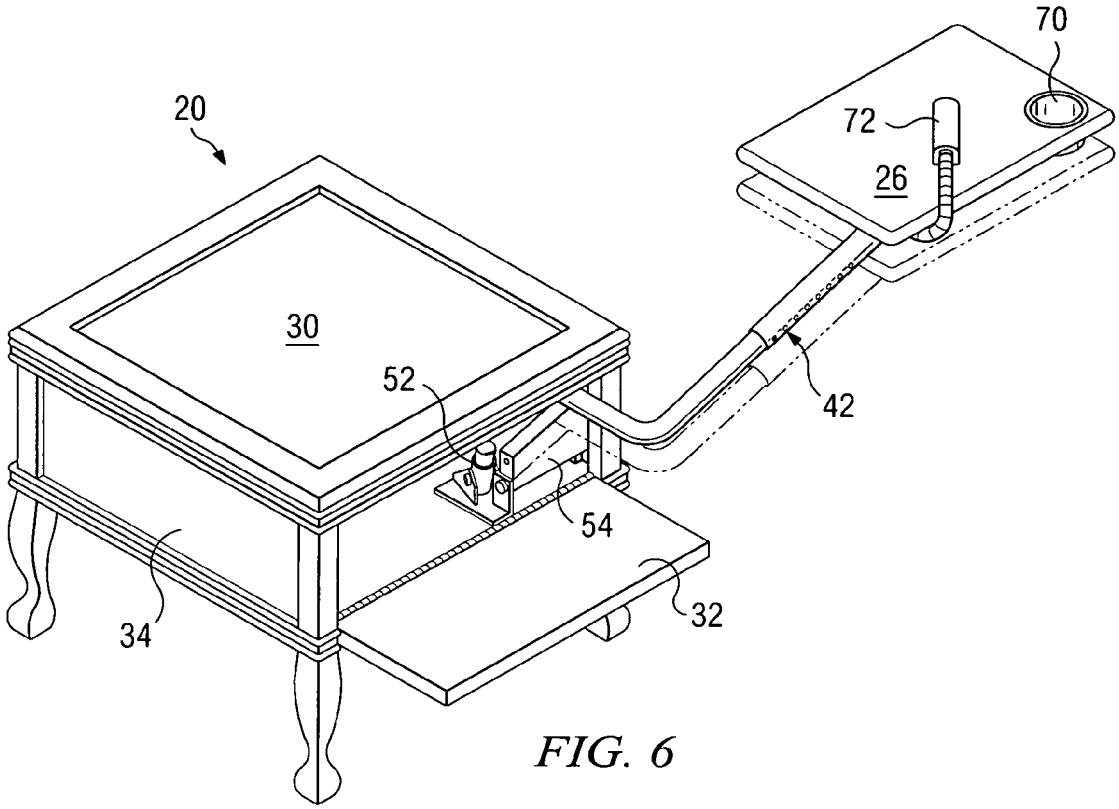
FIG. 6 is a perspective view illustrating the range of motion of one component of the embodiment shown in FIG. 1.

Referring to FIG. 6, there is shown the table 20, and the vertical range of motion of the arm 42. The arm 42 is adjusted vertically by adjusting the height of the cam 52 and the shelf 54 by changing the apertures in which the locking pins 58 are placed.

Figure 7:
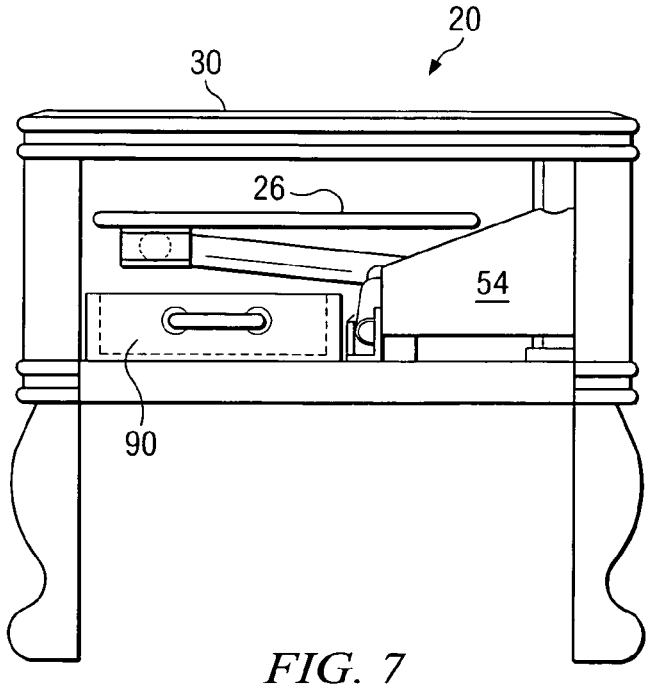
FIG. 7 is a perspective view illustrating the embodiment shown in FIG. 1 comprising an additional component.

Referring now to FIG. 7, there is shown the table 20 further comprising a drawer 90. The drawer 90 may be placed adjacent to the shelf 54 such that the drawer is located beneath the second support surface 26 when it is stored beneath the upper support surface 30.

Figure 9:
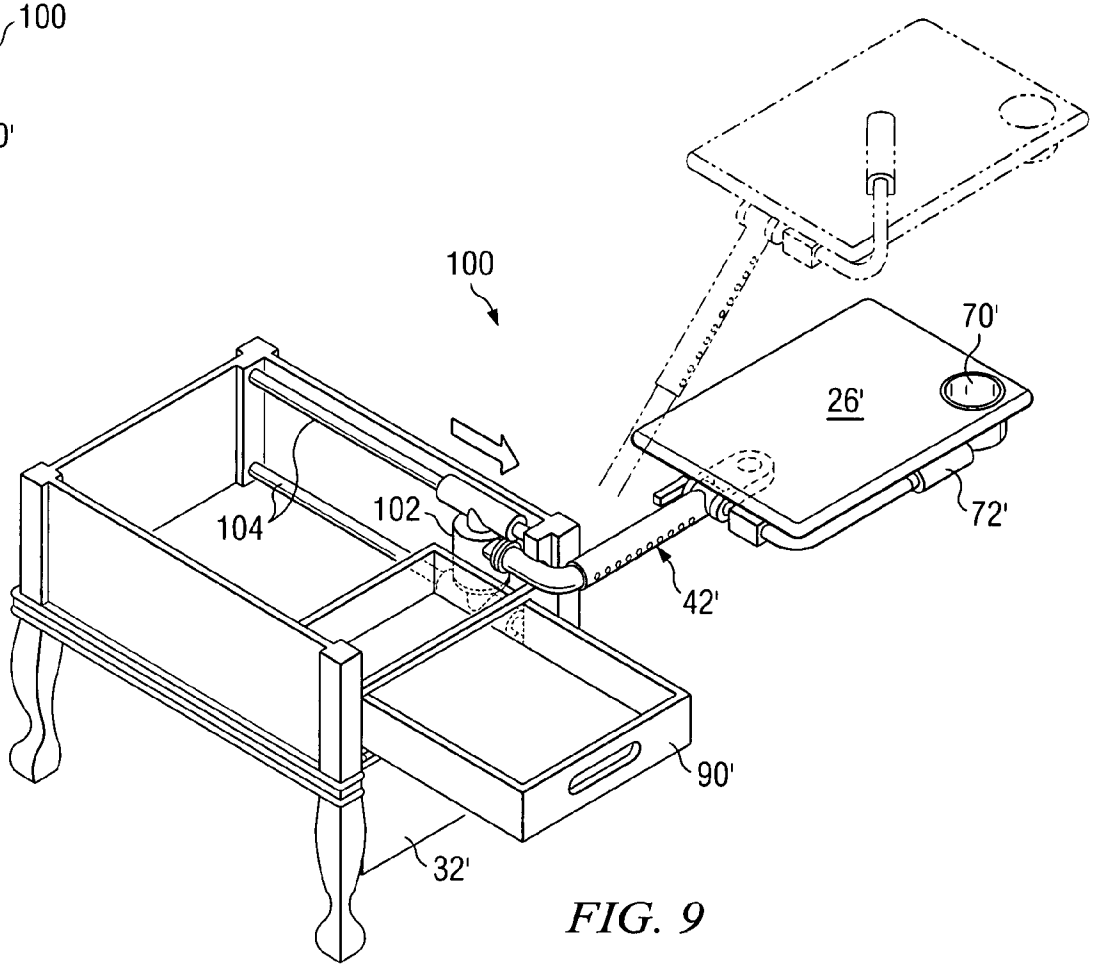
FIG. 9 is an alternate view of the embodiment shown in FIG. 8.
Figure 8:
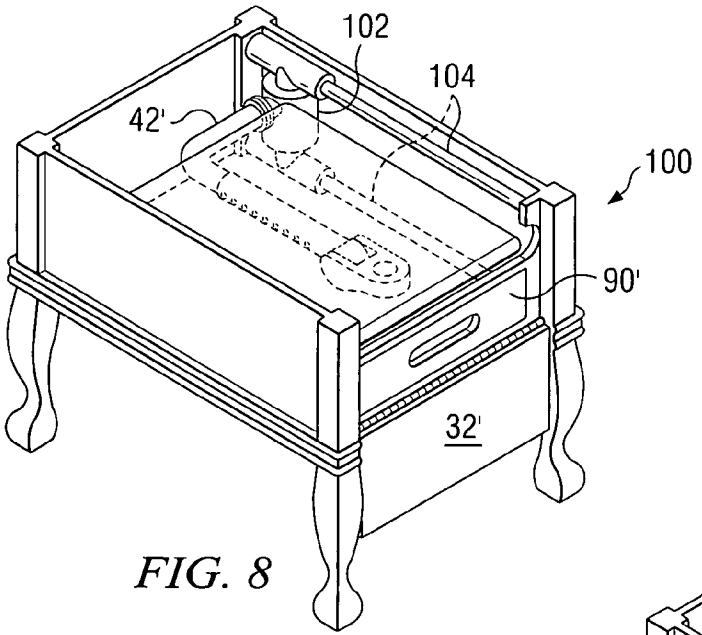
FIG. 8 is a perspective view illustrating another embodiment of the present invention.

Referring to FIGS. 8 and 9, there is shown a table 100 comprising a second embodiment of the invention. Many of the component parts of the table 100 are substantially identical in construction and function to component parts of the table 20 illustrated in FIGS. 1 through 7 and described hereinabove in conjunction therewith. Such identical component parts are designated in FIG. 7 with the same reference numerals utilized above in the description of the table 20, but are differentiated therefrom by means of a prime (') designation.

The table 100 differs from the table 20 shown of FIGS. 1 through 7 in that the table 100 comprises a horizontal arm 42' mounted on a rod 102 which slides horizontally on two rails 104 between a front panel 32' and a back panel 36'. The rod 102 and horizontal rails 104 may be fabricated from wood, various metals, or plastics known to those skilled in the art and commonly used in furniture manufacture. The second support surface 26' stores beneath an upper support surface 30' in a configuration wherein the front of the second support surface 26' rests parallel to the rails 104. The rod 102 slides along the rails as the second support surface 26' is pulled toward the front of the table 100. When the rod 102 meets the front end of the rails 104, the second support surface 26' rotates such that the front of the second support surface 26' becomes perpendicular to the rails 104. Once the second support surface 26' is rotated, the horizontal arm 42' rotates toward a person seated adjacent to the table 100. The support plate coupling the second support surface 26' to the arm 42' is hinged to allow the second support surface 26' to adjust to different vertical positions.

Figure 10:
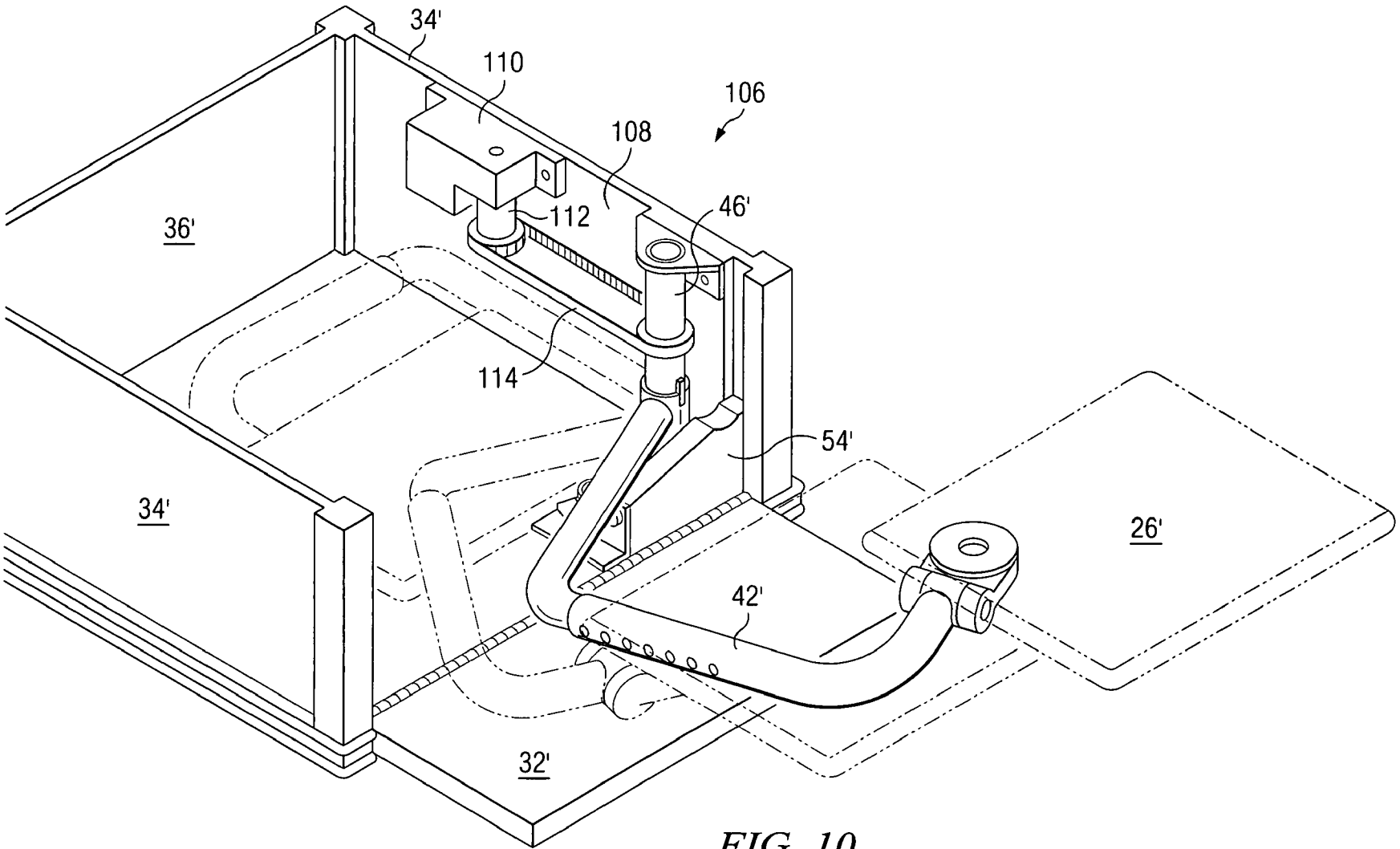
FIG. 10 is a perspective view illustrating another embodiment of the present invention.
Figure 11A:
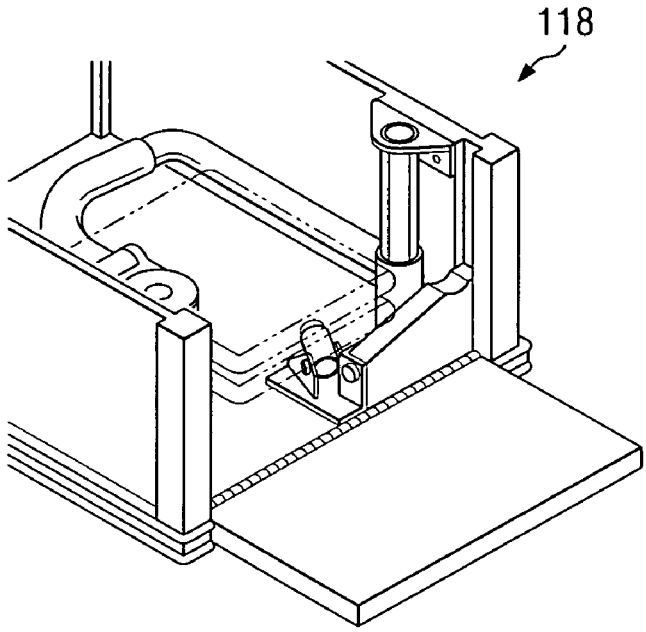
FIGS. 11A and 11B are a perspective views illustrating yet another embodiment of the present invention.
Figure 11B:
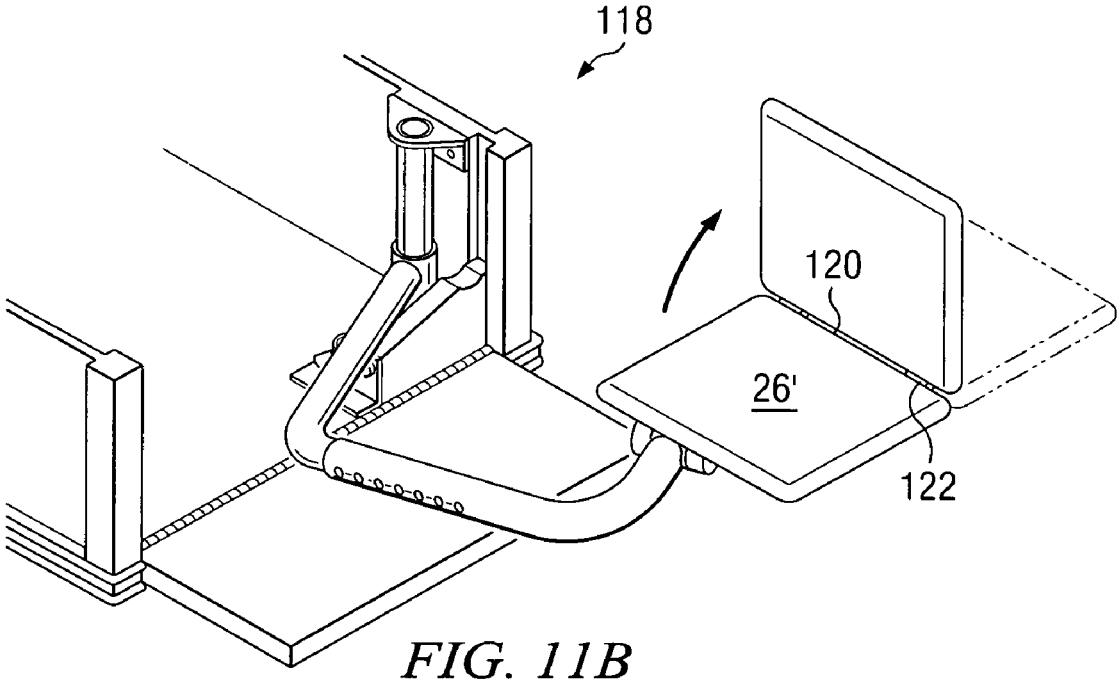

Referring to FIGS. 10, 11A, and 11B there is shown tables 106 and 118 comprising third and fourth embodiments of the invention, respectively. Here again, many of the component parts of the tables 106 and 118 are substantially identical in construction and function to component parts of the table 20 illustrated in FIGS. 1 through 7 and described hereinabove in conjunction therewith. Such identical component parts are designated in FIG. 7 with the same reference numerals utilized above in the description of the table 20, but are differentiated therefrom by means of a prime (') designation.

The table 106 in FIG. 10 is different as the horizontal arm 42' and second support surface 26' are automatically moved out of the enclosure defined by the upper support surface 30', the front panel 32', the two side panels 34', and the back panel 36' by the mechanism 108. The mechanism 108 comprises a drive motor and gear box 110, a drive shaft 112, and a pulley 114 that drives the vertical shaft 46' counter-clockwise to force the horizontal arm 42' and second support surface 26' out of the enclosure until the horizontal arm 42' makes contact with the shelf 54', at which point the mechanism 108 ceases to drive the vertical shaft. At that point an individual can manually move the horizontal arm 42' and second support surface 26' to the desired position.

The table 118 in FIGS. 11A and 11B is different in that the second support surface 26' can be folded in half along its centerline 120 via hinges 122 so that it requires substantially half the storage space and therefore the table 118 may be built substantially half as large as otherwise possible.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

The invention claimed is:

1. A table comprising:

a first support surface;

an enclosure located immediately below the first support surface;

a second support surface;

lever means supporting the second support surface on the table for movement between the enclosure and a location substantially displaced from the first support surface; and wherein the lever means supporting the second support surface comprises:

a horizontal arm coupled to the second support surface;

a vertical rod rotatably supporting the horizontal arm;

a spiral shelf comprising cradles at both ends wherein a bottom cradle supports the horizontal arm when the second support surface is recessed and stored within the enclosure; and a top cradle supports the arm when the second support surface is in use.

2. The table according to claim 1 further comprising a flexible light source mounted onto the second support surface.

3. The table according to claim 1 further comprising a cup holder mounted to the second support surface.

4. The table according to claim 1 further comprising a drawer within the enclosure.

5. The table according to claim 1 further comprising a drawer within the second support surface.

6. The table according to claim 1 wherein the lever means is actuated by a motor located within the enclosure of the table.

7. The table according to claim 1 wherein the second support surface can be folded in half for storage within the enclosure.

8. The table according to claim 1 wherein the shelf is vertically adjustable.

* * * * *